US011435159B1

(12) United States Patent
Jivoin et al.

(10) Patent No.: US 11,435,159 B1
(45) Date of Patent: Sep. 6, 2022

(54) INERTIA ACTIVATED PROJECTILE BLASTER AND METHODS

(71) Applicant: Hasbro, Inc., Pawtucket, RI (US)

(72) Inventors: Christopher Jivoin, Barrington, RI (US); Alexander Draper, Cumberland, RI (US); Joel Kramer, Bristol, RI (US)

(73) Assignee: Hasbro, Inc., Pawtucket, RI (US)

( * ) Notice: Subject to any disclaimer, the term of this patent is extended or adjusted under 35 U.S.C. 154(b) by 41 days.

(21) Appl. No.: 16/922,721

(22) Filed: Jul. 7, 2020

Related U.S. Application Data

(60) Provisional application No. 62/871,580, filed on Jul. 8, 2019.

(51) Int. Cl.

| | |
|---|---|
| ***F41B 7/08*** | (2006.01) |
| ***A63H 33/00*** | (2006.01) |
| ***F41B 11/89*** | (2013.01) |
| ***F41B 11/642*** | (2013.01) |

(52) U.S. Cl.
CPC ..... *F41B 11/89* (2013.01); *A63H 33/00* (2013.01); *F41B 7/08* (2013.01); *F41B 11/642* (2013.01)

(58) Field of Classification Search
CPC ..... F41B 11/642; F41B 11/89; F41B 7/08; A63H 33/00
USPC .... 124/1, 22, 40, 56, 59, 64, 65, 66, 67, 16; 446/26, 473, 487
See application file for complete search history.

(56) References Cited

U.S. PATENT DOCUMENTS

| | | | | | |
|---|---|---|---|---|---|
| 571,260 | A | | 11/1896 | Borchardt | |
| 961,511 | A | | 6/1910 | Marble | |
| 1,374,757 | A | | 4/1921 | Napier | |
| 2,423,448 | A | * | 7/1947 | Haight | F41C 9/02 2/160 |
| 2,977,951 | A | * | 4/1961 | Cavin | F41B 11/642 124/67 |
| 3,018,578 | A | * | 1/1962 | Hill | F41C 9/02 42/13 |
| 3,060,625 | A | * | 10/1962 | Glass | F41C 9/00 224/267 |
| 3,236,224 | A | | 2/1966 | Pitcher | |
| 3,385,279 | A | | 5/1968 | Pitcher | |
| 3,968,783 | A | | 7/1976 | Pfotenhauer | |
| 4,170,215 | A | | 10/1979 | Kettlestrings | |
| 4,248,202 | A | * | 2/1981 | Jaworski | F41B 7/08 124/16 |
| 4,659,320 | A | | 4/1987 | Rich et al. | |
| 4,768,681 | A | * | 9/1988 | Dean | F41B 9/0078 2/160 |
| 4,771,758 | A | | 9/1988 | Taylor et al. | |
| 4,820,229 | A | * | 4/1989 | Spraggins | A63H 33/00 446/485 |

(Continued)

*Primary Examiner* — Alexander R Niconovich
(74) *Attorney, Agent, or Firm* — Perry Hoffman

(57) ABSTRACT

A toy projectile apparatus which simply yet uniquely employs inertia, a weighted mass to trip a release point trigger release mechanism, and a safety mechanism latched to the weighted mass structure for releasing the mass to trigger shooting of the projectiles. The weighted mass cooperates with a release point trigger release mechanism which includes a trigger linkage and a release point element. The weighted mass will advance/shift/move with the trigger linkage toward a release point element when a force of a certain acceleration is applied to the projectile apparatus by a user.

20 Claims, 12 Drawing Sheets

(56) References Cited

U.S. PATENT DOCUMENTS 5,072,856 A * 12/1991 Kimble ..... F41B 9/0078 2/160
5,286,228 A * 2/1994 Lee ..... A63H 33/00 623/64
5,303,847 A * 4/1994 Cottone ..... F41B 9/0078 239/529
5,359,985 A * 11/1994 Schumacher ..... F41B 15/08 124/66
5,471,967 A * 12/1995 Matsuzaki ..... F41B 4/00 124/78
5,529,050 A * 6/1996 D'Andrade ..... F41B 11/723 124/56
5,611,322 A 3/1997 Matsuzaki et al.
5,673,436 A * 10/1997 Piper ..... F41H 9/10 2/163
5,678,730 A * 10/1997 Fabek ..... B65D 83/75 222/402.15
5,711,285 A * 1/1998 Stewart ..... F41B 11/642 124/67
5,724,955 A * 3/1998 Johnson ..... F41B 11/57 124/53.5
5,920,024 A * 7/1999 Moore ..... G10H 1/00 356/28
5,996,564 A * 12/1999 Kotowski ..... F41B 4/00 124/6
6,150,947 A * 11/2000 Shima ..... G10H 1/00 446/175
6,224,457 B1 * 5/2001 Wu ..... F41B 7/006 446/485
6,346,025 B1 * 2/2002 Tachau ..... A63H 17/34 403/114
RE37,616 E 4/2002 Schumacher
6,598,329 B1 * 7/2003 Alexander ..... F41C 27/00 42/76.01
6,626,728 B2 9/2003 Holt
6,733,356 B2 * 5/2004 Lee ..... A63H 27/14 124/31
6,814,260 B2 * 11/2004 Caffrey ..... B05B 9/0811 446/475
7,032,837 B2 4/2006 Eddins et al.
7,287,526 B1 * 10/2007 Bligh ..... F41B 11/643 124/63
7,418,797 B1 9/2008 Crose
7,437,847 B1 * 10/2008 Mabry ..... F41C 23/12 42/73
7,552,557 B1 * 6/2009 Mabry ..... F41A 11/04 42/71.01
7,673,624 B2 * 3/2010 Rosella, Jr. ..... F41B 7/08 124/16
7,731,061 B1 * 6/2010 Woodhouse ..... A63H 33/00 446/26
7,841,327 B2 * 11/2010 Sopinsky ..... A63H 33/18 124/16
8,057,309 B1 * 11/2011 Mead ..... A63F 13/837 463/47
8,336,531 B2 * 12/2012 Fan ..... F41A 11/02 42/75.02
8,567,378 B2 * 10/2013 Nugent ..... F41B 11/723 124/59
8,567,380 B2 * 10/2013 Nugent ..... F41B 11/643 124/64
8,876,574 B2 * 11/2014 Bourdelaise ..... A63H 37/00 446/475
2006/0242880 A1 * 11/2006 Griffin ..... F41C 23/04 42/73
2014/0326228 A1 * 11/2014 Poirier ..... F41B 7/08 124/16
2016/0018175 A1 * 1/2016 Lallier ..... F41B 5/12 29/428
2019/0301824 A1 * 10/2019 Maeda ..... F41B 11/89
2020/0025509 A1 * 1/2020 Pickerill ..... F41B 11/57

* cited by examiner

INERTIA ACTIVATED PROJECTILE BLASTER AND METHODS

PRIORITY CROSS-REFERENCE TO RELATED APPLICATION

This application claims priority pursuant to 35 U.S.C. 119(e) from U.S. Provisional Patent Application No. 62/871,580 filed on Jul. 8, 2019.

1. FIELD OF THE INVENTION

The present invention relates to toys and more particularly to a toy projectile blaster with an inertia trigger mechanism including an actuator movement mass that is selectively activated for shooting a projectile when the apparatus experiences a certain acceleration.

2. BACKGROUND OF THE INVENTION

Many kinds of shooting toys exist and are designed for the amusement of children and adults alike. Shooting toys come in various shapes with some of the most common toys shaped like guns of all sizes. Some known projectile discharge apparatuses include held or worn devices which are capable of shooting numerous projectiles. Some of these apparatuses are shaped like guns employing a variety of discharge ports and distribution mechanisms to conduct the pressurized gas or liquid to the discharge ports in order to eject solid projectiles or liquid and gas. Other known apparatuses are worn on the back of the hand of a user and employ a plurality of chambers capable of receiving numerous projectiles which are deployed by pulling each one of the multiple triggers linked to each one of the plurality of chambers. None of these projectile apparatuses however, employ an inertia trigger mechanism including an actuator movement mass that is selectively activated for shooting the projectile when the apparatus experiences a certain acceleration.

There is a known projectile discharge apparatus which employs a wearable housing which includes dart chambers. A curved trigger which is actuated by one or more fingers of a user is associated with each dart chamber to launch each dart separately, as exemplified and disclosed in reissued U.S. Pat. No. RE37,616, reissued Apr. 2, 2002 to Schumacher. A wearable housing is fit over the back of a user's hand with the user's fingers sliding through each curved trigger portion. Five projectile chambers are disposed on the housing for frictionally containing five darts at the same time. Each chamber includes a discharge member which is manually primed and includes a recessed portion into which an end of the trigger, opposite the curved finger portion, inserts, until the trigger is pulled by the user's finger to fire each dart.

Other known wearable projectile launchers include a wrist mounted launcher and/or gloves having dart and disc chambers disposed on the back of a user's hand and employing a trigger mechanism located at the dart or disc chamber for manually depressing, pushing or pulling by a user to fire the dart or disc. Other known wearable projectile launchers include a belt accessory strapping a launcher housing to the waist of a user and a firing mechanism secured to a body plate and worn by a user. A trigger button is depressed by the user to singly or automatically fire darts from the launcher housing strapped to the users belt, or a trigger handle is pulled to fire darts from the body plate or removed and fire darts from a hand held gun device.

U.S. Pat. No. 8,567,378 issued Oct. 29, 2013 to Nugent and assigned to Hasbro, Inc. entitled "Air Path and Safety Valve System for Toy Launchers" is hereby incorporated in its entirety by reference, and discloses an air path and improved safety valve combination for a toy air gun. An air passageway between multiple barrels includes multiple valve elements movable between an open and a closed position. A blast of compressed air is directed to an associated barrel for firing if a dart is contained within, or alternatively, the blast of compressed air will be diverted to cascade to the next barrel until a barrel with a loaded dart found.

Significantly, known projectile apparatuses and devices do not disclose or employ an intervening weight mass structure into the trigger linkages and a safety mechanism latched to the intervening weight mass structure for dictating when the mass will trigger shooting of the projectile. The weighted mass is locked by the safety mechanism when cocking the launcher and then released to a ready position where inertia will activate and trip the release point trigger release mechanism to shoot the projectile. The weighted mass cooperates with a release point trigger release mechanism which includes a trigger linkage and a release point element. The weighted mass will advance/shift/move with the trigger linkage toward the release point element when a force of a certain acceleration is applied to the projectile apparatus by a user. Alternatively, the weighted mass will advance/shift/move with the release point element toward the trigger linkage when a force of a certain acceleration is applied to the projectile apparatus by the user. The force applied can include as a punch, swipe, fling, chop, or other move, etc, of a user's hand/arm while wearing or holding the projectile apparatus. As the force is applied, the weighted mass, based on inertia, will advance/shift/move toward either the trigger linkage or the release point element to trip the release point trigger release mechanism and thus use inertia to shoot the dart.

SUMMARY OF THE INVENTION

The present invention addresses shortcomings of the prior art to provide a toy projectile apparatus which simply yet uniquely employs inertia, a weighted mass to trip a release point trigger release mechanism, and a safety mechanism latched to the weighted mass structure for releasing the mass to trigger shooting of the projectiles. The weighted mass cooperates with a release point trigger release mechanism which includes a trigger linkage and a release point element. The weighted mass will advance/shift/move with the trigger linkage toward a release point element when a force of a certain acceleration is applied to the projectile apparatus by a user. Alternatively, the weighted mass can advance/shift/move with the release point element toward the trigger linkage when a force of a certain acceleration is applied to the projectile apparatus by the user. The force applied can include as a punch, swipe, fling, chop, or other move, etc., of a user's hand/arm while wearing or holding the projectile apparatus. As the force is applied and the safety mechanism is released, the weighted mass, based on inertia, will advance/shift/move toward either the trigger linkage or the release point element to trip the release point trigger release mechanism and thus use inertia to shoot the projectile.

In one embodiment of the invention, a toy projectile apparatus includes a housing assembly with at least one projectile receiving assemblage. A projectile is received into the receiving assemblage and movably deployed within the assemblage. A launching mechanism, adjacent the projectile receiving assemblage, operates to launch the projectile from the assemblage, and a priming mechanism engages the launching mechanism for manual priming of the launching mechanism. A safety mechanism engages an actuator movement mass, and must release the mass before a "Power move" performed by a user will advance/shift the mass to shoot the projectile.

The launching mechanism and priming mechanism can form a sub-assembly within the housing of the apparatus. Generally, the launching mechanism includes a piston and compression launch spring housed within a cylinder. The priming mechanism includes a plunger rod affixed to the piston and a grip portion of the plunger rod disposed opposite a rod end affixed to the piston. The piston is movable with respect to the cylinder and apparatus housing assembly and is drawn away from the projectile receiving assemblage when primed by the plunger rod. Alternatively, the launching mechanism can include a torsion spring within a sub-housing assembly topped by a cap for ease in winding the torsion spring/launching mechanism to a primed position. The user grips the cap of the sub-housing assembly and rotates the assembly counter-clockwise until the torsion spring is wound to a primed position.

A release point trigger release mechanism is disposed within the housing assembly and engaging the launching mechanism. An actuator movement mass is deployed at the housing assembly and engages the release point trigger release mechanism. The actuator movement mass is selectively activated through a certain acceleration/"power move" to trip the release point trigger release mechanism and shoot the projectile from the projectile receiving assemblage.

The release point trigger release mechanism further includes a release point element affixed within the housing assembly and a trigger linkage disposed within the housing pivotably connected to move with the actuator movement mass for engaging the launching mechanism until actuated by selective movement of the actuator movement mass. Alternatively, the release point trigger release mechanism further includes one or more trigger linkages pivotably affixed within the housing assembly for engaging the launching mechanism and a release point element disposed within the housing and connected to move with the actuator movement mass when the apparatus experiences a certain acceleration.

In another embodiment, the actuator movement mass includes only a sub-housing assembly latched to the safety mechanism, which has enough weight and mass sufficient to trigger the release point trigger release mechanism and shoot a projectile when the safety mechanism has released the sub-housing assembly for movement. Additionally, the actuator movement mass and/or sub-housing assembly, can be disposed within the housing assembly or outside of the housing assembly.

The safety mechanism includes one or more linkage assemblies latching the actuator movement mass to a safety button accessible to a user for depressing and holding to release the safety mechanism from the mass and allowing the apparatus to shoot the projectile.

In another embodiment, a safety mechanism including a ball and channel configuration is included for preventing movement of the actuator movement mass and/or sub-housing assembly until the apparatus is aligned in such a position as to allow the ball to roll into a dip in the channel and free the mass to shift allowing the apparatus to shoot the projectile when desired by a user. In yet another embodiment, a wearable outer housing assembly is included for securing the housing to the user for a certain acceleration of the apparatus by the user.

The actuator movement mass is selectively activated through a particular movement of the toy projectile apparatus to activate the inertia trigger mechanism for shooting the projectile when the apparatus experiences a certain acceleration, as discussed above. "Power moves," of the toy projectile apparatuses by the user, provides the particular force and direction needed to advance/shift/move the actuator movement mass to trip the inertia trigger mechanism. For example, a Captain Marvel superhero inspired toy projectile apparatus would require a user to perform a punching motion when wearing the Captain Marvel projectile apparatus in order to advance the actuator movement mass and shoot the projectile. The punching motion is a "Power move" of Captain Marvel and the outer housing design and embellishment of the Captain Marvel projectile apparatus suggests to the user that the "Power move" to be performed would be a punching motion.

Additionally, alternative toy projectile apparatuses inspired by other superheroes' include alternative outer housing assembly designs and embellishments, some with wearable component and some including hand held housing assemblies, but each inspired by and indicating a particular superhero. The look of the outer housing assembly of each also suggests a "Power move" by the corresponding superhero, to be performed by the user in order to shoot projectiles from the apparatus. For example, a Spiderman inspired toy projectile apparatus would suggest a palm up flip of the wrist "Power move" to shoot projectiles, a Black Panther inspired toy projectile apparatus would suggest a cat like paw swipe "Power move" to shoot projectiles, a Captain America inspired toy projectile apparatus suggesting a frisbee like flick of the arm disc throw "Power move" to shoot projectiles, and a Thor inspired toy projectile apparatus would suggest a hand held hammer swing motion "Power move" to shoot projectiles. It is also contemplated that various other superhero inspired toy projectile apparatuses could be included.

In another embodiment, a method for shooting a projectile from a toy projectile apparatus, including the steps of: providing a housing assembly having at least one projectile receiving assemblage, loading a movably deployable projectile into the projectile receiving assemblage, providing a launching mechanism adjacent the projectile receiving assemblage for launching the projectile from the assemblage. Manually priming the launching mechanism with a priming mechanism, engaging the launching mechanism with a release point trigger release mechanism disposed within the housing assembly, and providing an actuator movement mass deployed at the housing assembly and engaging the release point trigger release mechanism, selectively activating the actuator movement mass through a certain acceleration to trip the release point trigger release mechanism and shoot the projectile from the projectile receiving assemblage.

BRIEF DESCRIPTION OF THE DRAWINGS

For the purpose of facilitating an understanding of the invention, the accompanying drawings and detailed description illustrate a preferred embodiment thereof, from which the invention, its structures, its constructions and operations, its processes, and many related advantages may be readily understood and appreciated.

FIG. 1C illustrates a launching and priming mechanism sub-assembly and an actuator movement mass and release point trigger release mechanism within the housing assembly, with a trigger linkage movable with the mass and a release point element affixed to the housing assembly, while

FIG. 2B illustrates a safety mechanism for preventing advancing/shifting an actuator movement mass, until shooting the projectile is desired by the user; while

FIG. 3C illustrates a launching and priming mechanism sub-assembly and an actuator movement mass and release point trigger release mechanism within the housing assembly, including a release point element movable with the mass and two trigger linkages, one pivotably secured to the housing assembly and the other latching a plunger to retain the launching mechanism in a primed position, while

FIG. 4B illustrates a safety mechanism at a rail/handle housing latched to an actuator mass within the wearable housing for preventing advancing/shifting of the actuator movement mass until shooting the projectile is desired by the; while

FIG. 5A is a perspective view of an alternative embodiment of the toy projectile apparatus according to the present invention, illustrating a hand held housing assembly with Thor indicia and a user releasing the safety mechanism and applying a Thor Power hand held hammer/chop move to shoot a projectile from a projectile receiving assemblage, while

DETAILED DESCRIPTION OF THE EMBODIMENTS

Figure 1A:
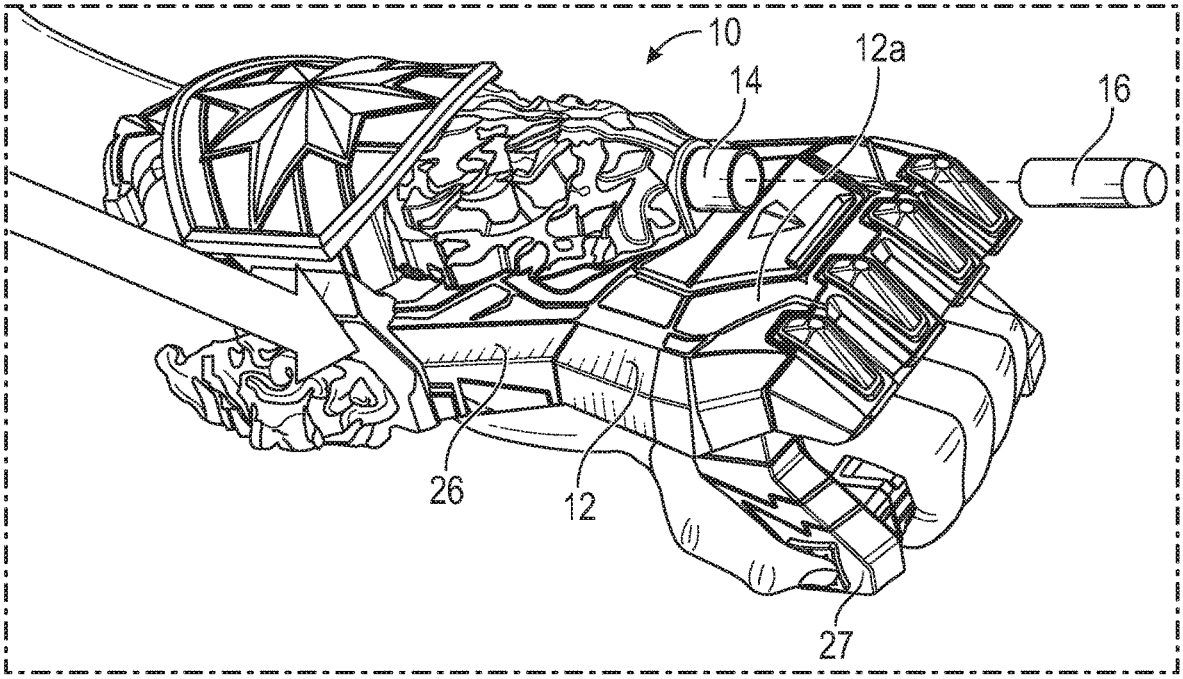
FIG. 1A is a perspective view of a toy projectile apparatus according to the present invention, illustrating a wearable housing assembly with Captain Marvel indicia with a user releasing the safety mechanism and applying a Captain Marvel recognizable punching move to shoot a projectile from a projectile receiving assemblage.

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

A toy projectile apparatus 10, as seen in FIGS. 1A-1D, is generally a wearable or hand held projectile blaster employing an inertia trigger mechanism which utilizes an actuator movement mass to trip an internal trigger mechanism which is selectively activated to shoot a projectile when the toy apparatus experiences a certain acceleration. At least one safety mechanism engages the actuator movement mass and must be released by a user to allow advancement/shifting of the actuator movement mass in order to trip the internal trigger mechanism.

A housing assembly 12 supports at least one projectile receiving assemblage 14 with a projectile 16 movably deployed within each assemblage. A launching mechanism 18 is disposed adjacent the projectile receiving assemblage and is charged/primed by a priming mechanism 20 which manually engages and primes the launching mechanism. A release point trigger release mechanism 22 is disposed within the housing and includes one or more trigger linkages and a release point element. The release point trigger release mechanism engages the launching mechanism and cooperates with an actuator movement mass 24 which is deployed at the housing and selectively activated through a certain acceleration to trip the release point trigger release mechanism and shoot the projectile from the assemblage.

The actuator movement mass is selectively activated through a particular movement of the toy projectile apparatus to activate the inertia trigger mechanism for shooting the projectile when the apparatus experiences a certain acceleration, as discussed above. "Power moves," of the toy projectile apparatuses by the user, provides the particular force and direction needed to advance/shift/move the actuator movement mass to trip the inertia trigger mechanism. "Power move" include iconic or signature moves seen to be performed by many known superhero's and include moves which users perform to imitate specific superheroes as they engage in role play and perform gestures or animations meant to imitate a particular superhero during play.

For example, a Captain Marvel superhero inspired toy projectile apparatus, as seen in FIG. 1A, would require a user to perform a punching motion when wearing the Captain Marvel projectile apparatus in order to advance the actuator movement mass and shoot the projectile. The punching motion is a "Power move" of Captain Marvel and the outer housing design and embellishment of the Captain Marvel projectile apparatus suggests to the user that the "Power move" to be performed would be a punching motion.

Additionally, alternative toy projectile apparatuses inspired by other superheroes include alternative outer housing assembly designs and embellishments, some with wearable component and some including hand held housing assemblies, but each inspired by and indicating a particular superhero. The look of the outer housing assembly of each also suggests a "Power move" by the corresponding superhero, to be performed by the user in order to shoot projectiles from the apparatus. For example, a Spiderman inspired toy projectile apparatus would suggest a palm up flip of the wrist "Power move" to shoot projectiles, a Black Panther inspired toy projectile apparatus would suggest a cat like paw swipe "Power move" to shoot projectiles, a Captain America inspired toy projectile apparatus suggesting a frisbee like flick of the arm disc throw and/or punch "Power move" to shoot projectiles, and a Thor inspired toy projectile apparatus would suggest a hand held hammer swing motion "Power move" to shoot projectiles. It is also contemplated that various other superhero inspired toy projectile apparatuses could be included.

The housing assembly 12, as seen in FIG. 1A, includes a wearable component 26, and a hand held rail/handle housing 27 generally comprised of a durable plastic material with the wearable component worn on the back of the hand of a user, with the user gripping the rail. A flexible strap 28 is included to secure the wearable component to the wrist/arm of the user. The strap (as well as the housing assembly itself) may also provide means for securing extra projectiles for future use. In the present described embodiment, an outer portion 12*a* of the housing assembly 12 is shaped and embellished to resemble equipment used and worn by superhero Caption Marvel, with body armor hand protector plates at the fingers and knuckles and fantasy flame embellishments for a battling effect. Additionally, the look of the outer housing portion 12*a* suggests a punch "Power move" to be performed by the user to shoot the projectile, as demonstrated by the arrow as shown in FIG. 1A.

At least one projectile receiving assemblage 14 is disposed at the housing assembly 12. The projectile receiving assemblage 14 is shaped and sized to fit a particular projectile size and shape used with any of the desired projectile apparatuses. For example, a cylindrical dart or disc shaped dart, will dictate the size and shape of the projectile assemblage used with a desired projectile apparatus. In the present described embodiment, as seen in FIGS. 1A-1D, the projectile receiving assemblage 14 is cylindrical in shape to receive a cylindrical dart projectile 16 which is movably deployed within the cylindrical chamber/barrel/assemblage 30. The assemblage 30 is secured to the housing and held in place when engaging the launching mechanism for shooting the dart 16 which is movably deployed within the assemblage.

Figure 1B:
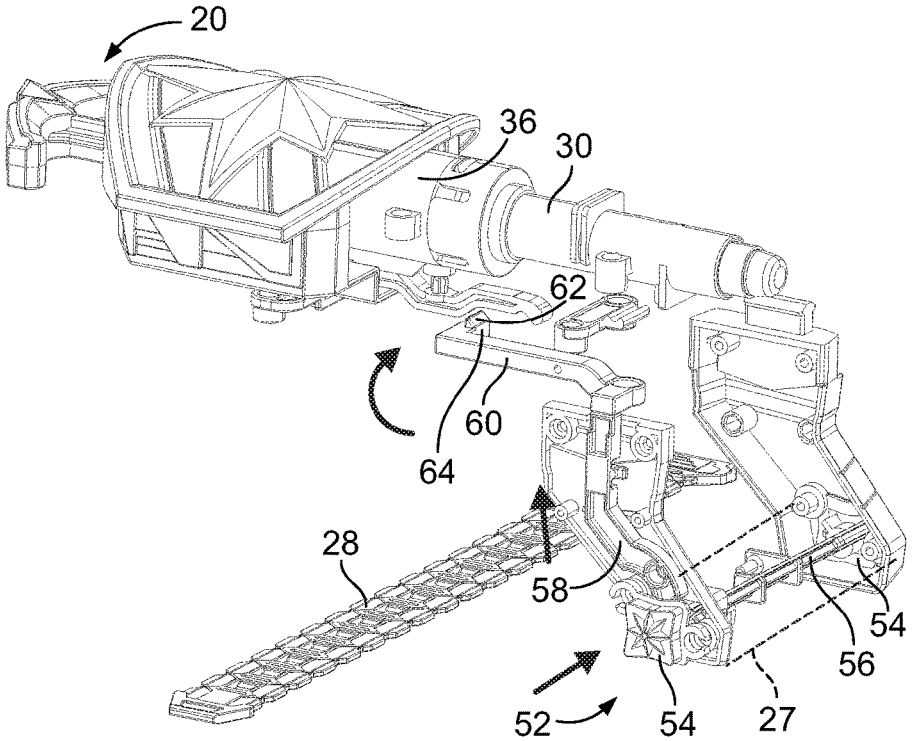
FIG. 1B illustrates a safety mechanism at a rail/handle housing, latched to an actuator mass and/or the sub-housing assembly within the wearable housing for preventing advancing/shifting of the actuator movement mass until shooting the projectile is desired by the user.
Figure 1C:
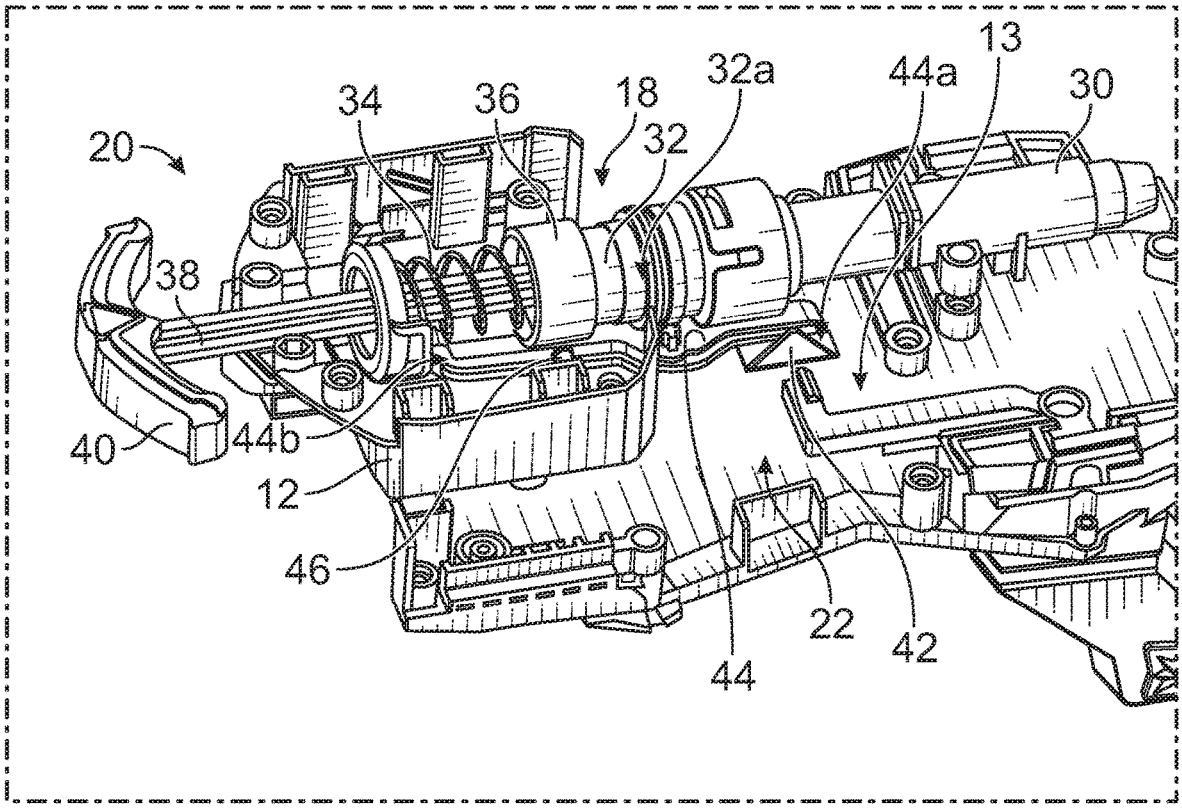

The launching mechanism 18 is disposed adjacent the projectile assemblage for launching the projectile from the projectile receiving assemblage. In the present described embodiment, as seen in FIGS. 1B & 1C, the launching mechanism generally includes a piston 32 and compression launch spring 34 housed within a cylinder 36, such that when the dart is launched, the air above the piston 32 in the cylinder 36 quickly enters the assemblage 30 behind the dart to cause shooting. It is also contemplated that the launching mechanism can include an electrically initiated plunger mechanism which advances projectiles into spinning flywheels to be shot from a toy projectile apparatus.

The priming mechanism 20 engages the launching mechanism 18 for manual charging/priming of the launching mechanism. The launching & priming mechanisms together form a sub-assembly that moves, with respect to the housing assembly, between a primed and discharged position. In the present described embodiment, as seen in FIG. 1C, the priming mechanism includes a plunger rod 38 affixed to the piston 32 and includes a grip portion 40 disposed at the plunger rod at an end of the rod opposite the piston. The piston 32 is movable with respect to the cylinder 36, and housing assembly 12, and is drawn away from the assemblage/chamber 30 when primed. The grip is pulled by the user drawing the plunger and affixed piston away from the assemblage and compressing the spring as the piston is temporarily latched to a primed/charged position.

A release point trigger release mechanism 22 is disposed within the housing assembly and engaging the launching assembly to temporarily latch the launching assembly to a primed/charged position. The release point trigger release mechanism includes one or more trigger linkages and a release point element. In the present described embodiment, as seen in FIG. 1C, the release point trigger release mechanism includes a protrusion release point element 42 affixed to the housing assembly and an internal trigger linkage 44 disposed within the housing assembly adjacent the launching mechanism for engaging the piston of the launching mechanism.

The protrusion 42 is generally a small tringle shaped block affixed to, or integral with, a bottom plate 13 of the housing assembly. The trigger linkage 44 is a long slim linkage with a first surface 44*a* at an end of the trigger linkage shaped to engage the protrusion. The trigger linkage 44 has a second surface 44*b*, at an end of the trigger linkage opposite the first surface 44*a*, which is shaped to latch onto a ring catch surface 32*a* of the piston for latching the piston to a primed/charged position.

The trigger linkage pivots at a pivot point 46 such that only one of the first surface or the second surface is capable of engaging it's corresponding protrusion or catch surface, respectfully, at a time. The trigger linkage latches the piston to a primed position until the trigger is released in which the trigger linkage is slid into the protrusion which will link the second surface of the trigger linkage with protrusion and pivot the first surface away from the piston catch to rapidly release the piston. The trigger linkage 44 is pivotably connected to move with the actuator movement mass for engaging the launching mechanism until actuated by selective movement of the actuator movement mass.

Figure 1D:
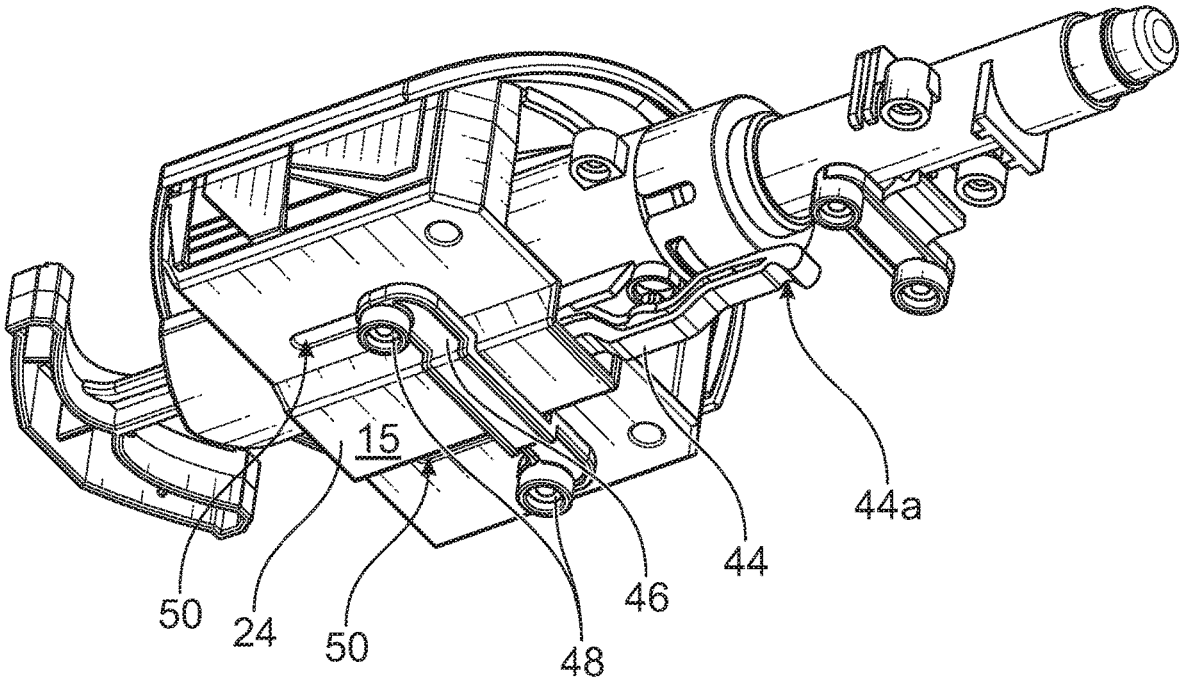
FIG. 1D illustrates a sub-housing assembly containing the actuator movement mass and advancing along a defined path with an affixed trigger linkage.

The actuator movement mass 24, as seen in FIG. 1D, is deployed at the housing assembly and engaging the release point trigger release mechanism. The actuator mass is selectively activated through a certain acceleration to trip the release point trigger and shoot the projectile from the projectile receiving assemblage. The actuator movement mass is generally a weight contained within a sub-housing 15 which links to the trigger release mechanism and is movably deployable with respect to the housing. The sub-housing rests on a bracket 46 which guides the sub-housing as it moves back and forth. A pair of pins 48 attach the bracket to the housing assembly and the pins ride along a pair of channels 50 in a rear portion 24 of the sub-housing. In the present described embodiment, the channels 50 provide a defined path in which the sub-housing (which is the actuator movement mass in the present described embodiment) travels with respect to the housing assembly for secure and rapid advancing/shifting between a nonactive position and an active position for shooting projectiles from the toy projectile apparatus.

The actuator movement mass is a weight of a particular size, weight and shape that fits mostly within the parameters of the housing assembly, sufficient to easily advance/shift from a certain acceleration applied to the apparatus. The Actuator movement mass is generally contained within a sub-housing that is disposed to shift with respect to the housing assembly, and alternatively the actuator movement mass can include only the sub-housing and/or be entirely disposed outside the housing assembly. In the present described embodiment, the actuator movement mass includes just the sub-housing 15 which is substantial enough to provide the rapid shift of weight within the housing assembly to trip the release point trigger release mechanism and shoot the projectile. Alternatively, if desired, a weight can be contained within the sub-housing.

In the present described embodiment, the internal trigger linkage 44 is pivotably connected to sub-housing 15 to slide as the actuator movement mass. The trigger linkage engages the launching mechanism until actuated by selective movement of the actuator movement mass. In operation, the second surface of the trigger linkage engages the ring catch surface of the piston when the launching mechanism is primed. Selective movement of the actuator movement mass from a "Power punching move" by the user shifts the mass and connected trigger linkage toward the protrusion until the first surface of the trigger linkage fully engages the protrusion and comes to a rest on top of the triangular protrusion. As the first surface 44*a* of the trigger linkage engages the protrusion, the trigger linkage is pivoted at the pivot point 46 shifting the second surface 44*b* of the trigger linkage away from engagement with the catch of the piston to release the primed piston to shoot the projectile from the toy projectile apparatus. After shooting the projectile, the actuator movement mass is returned to an inactive/unadvanced/unshifted position by the priming mechanism, when the launching mechanism is once again primed, as the priming mechanism mechanically engages the mass though one or more linkages/sub-housing.

As discussed above, a force applied to the toy projectile apparatus can include a punch, swipe, fling, chop, or other move, etc, of the user's hand/arm while wearing or holding the projectile apparatus. As the force is applied, the weighted mass, based on inertia, will advance/shift/move toward (either the trigger linkage or the release point element, depending on the embodiment) to trip the release point trigger release mechanism and thus use inertia to shoot the projectile. In the present described embodiment, as seen in FIGS. 1A-1D, the force applied is a punch "Power move" advancing the actuator movement mass with pivotably connected trigger linkage toward the protrusion release point element 42 to shoot projectiles from the toy projectile apparatus 10. The punching Power move provides enough acceleration to activate the inertia trigger mechanism. Other Power moves, inspired by other superhero wearable and hand held blasters are discussed in detail below.

A safety mechanism engages the actuator movement mass to prevent advancing/shifting of the mass to actuate the trigger and shoot the projectile, unless desired by the user. As described above, the safety mechanism must be released by the user in order to free the actuator movement mass and/or sub-housing assembly to advance/shift for shooting the projectiles. The safety mechanism includes one or more linkage assemblies latching the actuator movement mass and/or sub-assembly to one or more safety buttons accessible to the user for depressing and holding in order to release the safety mechanism from the mass and allow the apparatus to shoot the projectile. The safety button mechanically engages the one or more linkages between the button and the actuator movement mass to enable the safety button to be easily and logically accessible to the user when wearing or gripping the toy projectile apparatus. The safety button is spring loaded and biased to a position that engages the actuator movement mass preventing it from shifting and shooting the projectile. Depressing the one or more safety buttons releases the safety mechanism from engagement with the actuator movement mass allowing the mass to shift and actuate the toy projectile apparatus to shoot the projectile.

In the present described embodiment, as seen in FIG. 1B, a safety button 54 is disposed on either/both sides of the rail element 27. The buttons are easily depressed by the thumb of either the users right and/or left hand as the user grips the rail with each hand in use. A first linkage 56 runs through the rail element and connects the safety buttons to a second linkage 58 which is disposed on a fixed track in the housing assembly 12. A third linkage 60 mechanically engages the second linkage within the housing assembly and includes a latch element 62 for engaging the actuator movement mass at the sub-housing.

In operation, when either safety button 54 in depressed, the first linkage shifts causing the second linkage to move upward toward the third linkage and press on the third linkage causing it to rotate counter-clockwise, as seen with the arrows included in FIG. 1B. Rotation of the third linkage will pull the latch element 62 out of the way of the sub-housing/actuator movement mass freeing the mass to shift along the channels 50 if a force with a certain acceleration is applied, such as a punch motion as described above. When the safety buttons 54 are released, the spring loaded button will pull away from the rail, reversing the linkage movement and a small arm 64 on the third linkage will force the third linkage clockwise and reinstate the latch element 62 to prevent the actuator movement mass from freely advancing.

As described above, the toy projectile apparatus 10 includes a housing assembly 12 which can includes a wearable outer housing or a hand held outer housing assembly. The wearable outer housing can include a hand portion or glove element with or without a strap element for securing the apparatus to a hand, wrist or arm of the user, or alternatively, the outer housing may include a handle for gripping the apparatus in a lateral or vertical position.

The wearable outer housing assembly and/or the hand held outer housing assembly is shaped and embellished to resemble equipment used and worn by a superhero such as Captain Marvel, as discussed above in FIGS. 1A-1D, or alternative superhero's as discussed in detail below. Alternative embodiments of the toy projectile apparatus includes housing shapes and embellishments to resemble equipment used and worn by superhero's such as Spiderman, Black Panther, Captain America, and Thor, etc, as well as modified launching & priming mechanisms and release point trigger release mechanisms, but the inertia trigger driven by an advancing/shifting actuator movement mass remains a constant and novel structure in all the toy projectile apparatus embodiments.

Figure 2A:
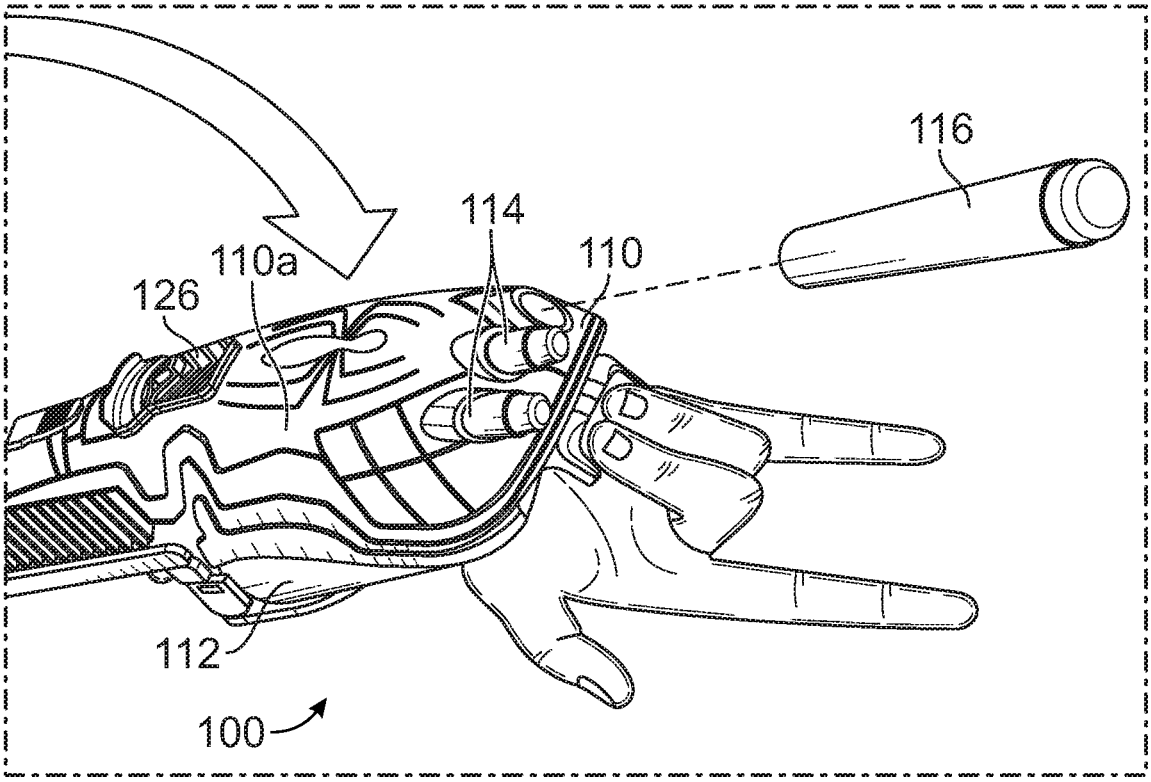
FIG. 2A is a perspective view of an alternative embodiment of the toy projectile apparatus according to the present invention, illustrating a wearable housing assembly with Spiderman indicia and a user releasing the safety mechanism and applying a Spiderman iconic palm up flip of the wrist move to shoot a projectile from a projectile receiving assemblage.
Figure 2B:
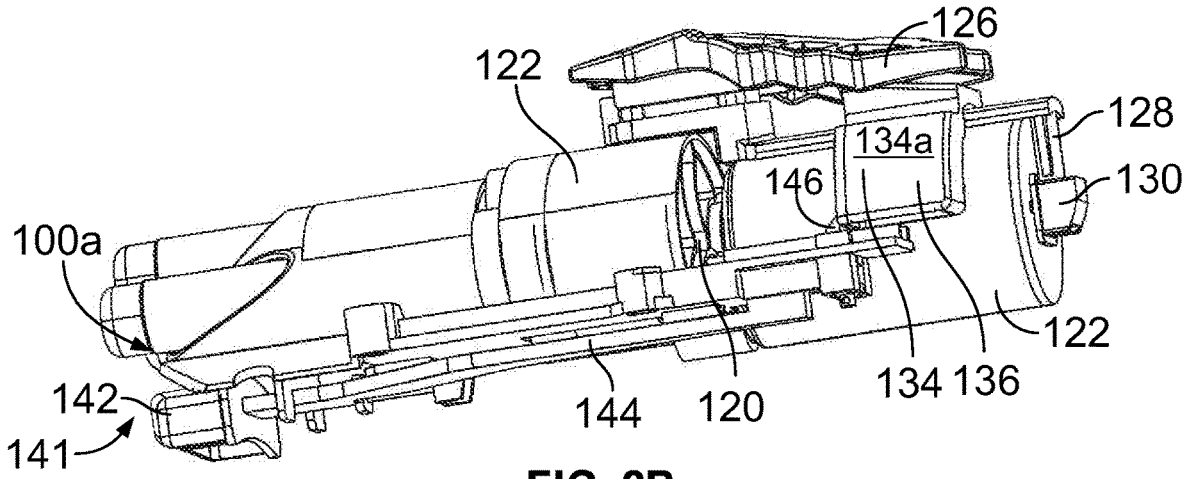
Figure 2C:
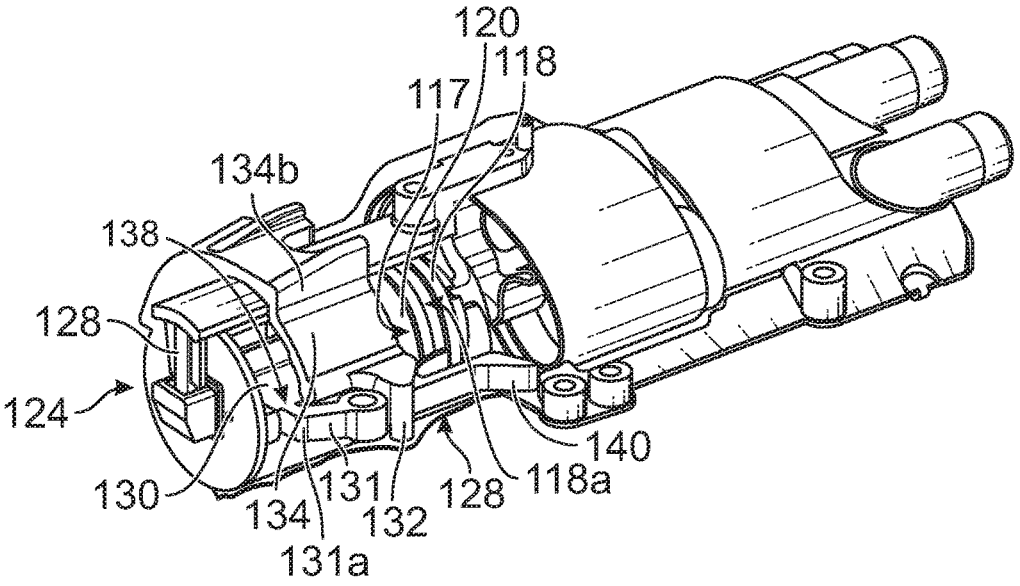
FIG. 2C illustrates a launching and priming mechanism sub-assembly and an actuator movement mass/sub-housing with a release point element movable with the mass and a trigger linkage pivotably secured to the housing assembly.

In an alternative toy projectile apparatus embodiment 100, as seen in FIGS. 2A-2C, a housing assembly 110 is generally comprised of a durable plastic with a wearable component designed to fit in the palm of a user's hand and secure to the users wrist with a strap 112. The outer housing portion 110*a* of the housing assembly is shaped and embellished to resemble equipment worn and used by a superhero such as Spiderman, with the web graphics and spider shaped handle for charging the launching mechanism, as well as the manner in which the apparatus is positioned on the wrist and palm of the user suggesting a flip of the wrist/arm "Power move", with the palm facing up, to apply the appropriate force and direction of acceleration needed to trip the inertia trigger in the present described alternative toy projectile apparatus 100.

Three projectile receiving assemblages 114 are disposed at the housing assembly and are cylindrically shaped to fit the cylindrical darts 116 which are movably deployed within each projectile receiving assemblage. A launching mechanism 117, generally similar to the launching mechanism as described above for the toy projectile apparatus 10, includes a piston 118 and a compression launch spring 120 housed within a cylinder 122, such that when one or more of the darts are launched, the air above the piston 118 in the cylinder 122 quickly enters the projectile receiving assemblages 114 behind the one or more darts to cause shooting of the darts.

A priming mechanism 124 engages the launching mechanism 117 for manual charging/priming of the launching mechanism. The launching and priming mechanisms together form a sub-assembly that moves with respect to the housing assembly between a primed and discharged position. The priming mechanism, as seen in FIGS. 2A & 2B, includes a spider shaped handle 126 connected to a linkage 128 which mechanically engages the plunger 130 that is affixed to the piston 118. The user pulls back on the handle 126, drawing the plunger and affixed piston away from the projectile receiving assemblages and compressing the spring 120 as the piston is temporarily latched to a primed/charged position.

A release point trigger release mechanism further includes one or more trigger linkages pivotably affixed within the housing assembly for engaging the launching mechanism and a release point element disposed within the housing assembly and connected to move with an actuator movement mass when the apparatus experiences a certain acceleration. In the present described alternative embodiment, a release point trigger release mechanism 128 is disposed within the housing assembly adjacent the cylinder 122 and engaging the launching assembly 117 to temporarily latch the launching assembly to a primed/charged position. In the present described alternative embodiment, the release point trigger release mechanism 128, as seen in FIG. 2C, includes a trigger linkage 131, pivotably secured to the housing assembly and a release point post element 132. The release point post 132 is affixed to a sub-housing assembly 134 that houses an actuator movement mass 136. The post 132 shifts with the sub-housing assembly when the sub-housing is shifted by the actuator movement mass.

The actuator movement mass is housed in the sub-housing assembly 134 in a protruded portion 134*a*, as seen in FIG. 2B. The sub-housing assembly is designed to contain the actuator movement mass and travel as a unit back and forth within the housing along the cylinder. An extended portion 134*b* of the sub-housing assembly, as seen in FIG. 2C, envelopes a portion of the cylinder and is affixed to the release point post 132, disposing the post adjacent the trigger linkage 131. The trigger linkage 131 includes an L shaped end 131*a* which extends through an aperture 138 in the cylinder for engaging a ring catch surface 118*a* of the piston when the launching mechanism/piston is in a primed position.

A safety mechanism 141, as seen in FIG. 2B, of the present described alternative embodiment, includes a spring biased safety button 142 disposed at a front end 100*a* of the apparatus 100 and easily depressed and held by the two middle fingers of the user as a Spiderman flip "Power move" is performed. A first linkage 144 extends the length of the apparatus and engages a second linkage 146 which mechanically engages the sub-housing 134 and prevents the actuator movement mass 136 from advancing to trip the release point trigger release mechanism until the user is ready to shoot projectiles from the apparatus.

In operation, the user will hold the safety button depressed before and during performance of the "Power move" which will shift the second linkage away 146 away from the sub-housing and allow the actuator movement mass to advance. Selective movement of the actuator movement mass with a "Power move" by the user shifts the mass and affixed release point post 132 toward an arm 140 of the trigger linkage at an end of the trigger opposite the L shaped end 131*a*, to pivot the L shaped end away from engagement with the piston to shoot the projectiles 116. The "Power move" used to activate the inertia trigger mechanism for the present described alternative apparatus 100, is a flip of the wrist movement, as shown in FIG. 2A, which provides the appropriate acceleration to advance the actuator movement mass 136 and trip the release point trigger release mechanism and shoot the projectiles. After shooting the projectile, the spring biased safety button is released, the second linkage 146 will automatically re-engage the sub-housing and the actuator movement mass is returned to an inactive/unadvanced/unshifted position by the priming mechanism, when the launching mechanism is once again primed, as the priming mechanism mechanically engages the mass though one or more linkages/sub-housing.

Figure 3A:
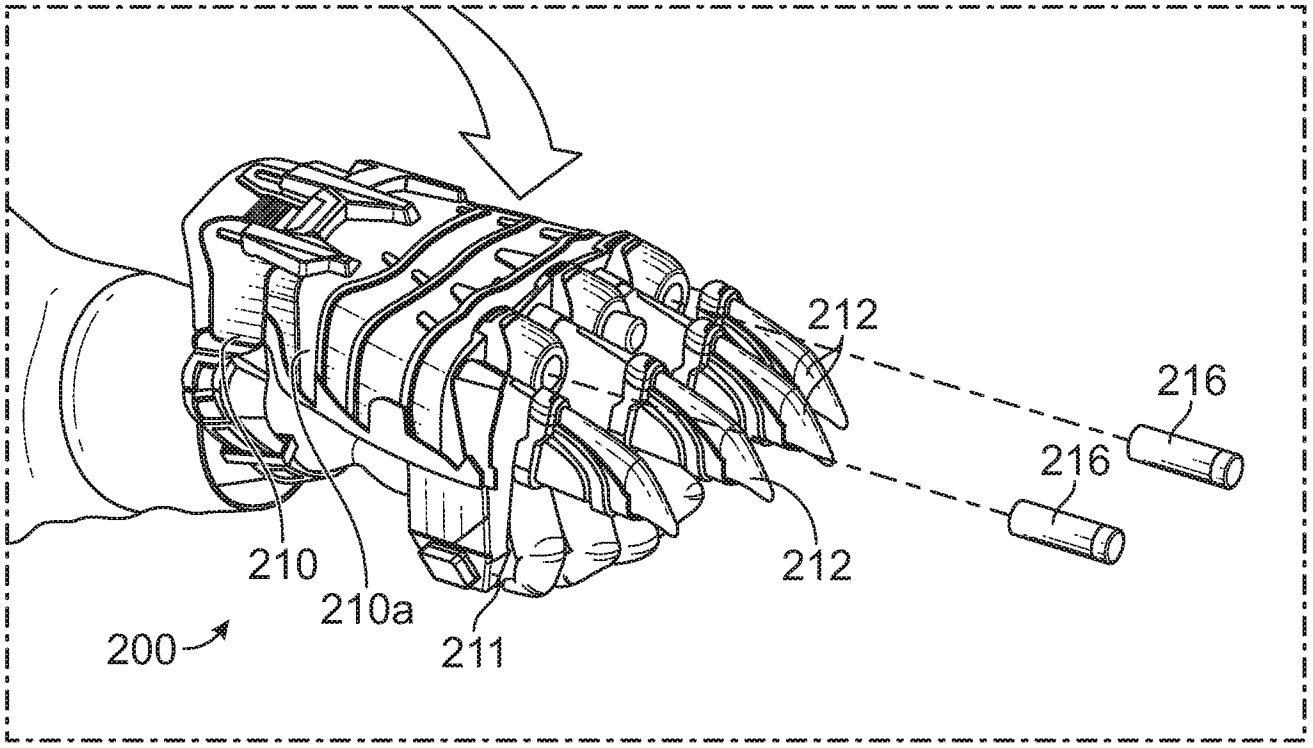
FIG. 3A is a perspective view of an alternative embodiment of the toy projectile apparatus according to the present invention, illustrating a wearable housing assembly with Black Panther indicia and a user applying a Black Panther Power cat like paw swipe move to shoot a projectile from a projectile receiving assemblage.
Figure 3B:
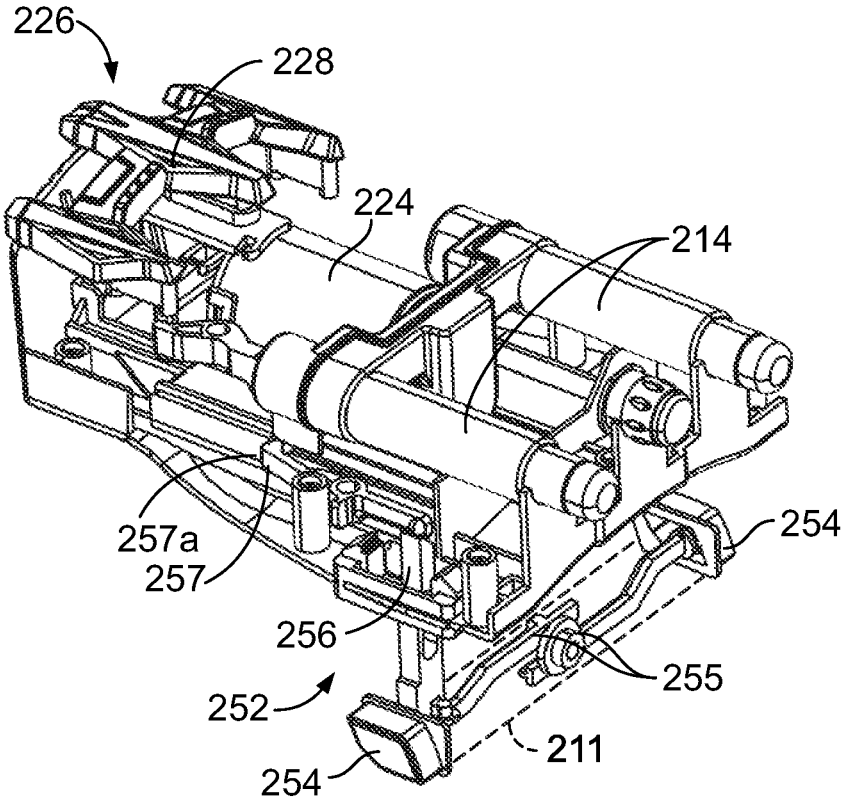
FIG. 3B illustrates a safety mechanism at a rail/handle housing latched to an actuator mass within the wearable housing for preventing advancing/shifting of the actuator movement mass until shooting the projectile is desired by the user.
Figure 3C:
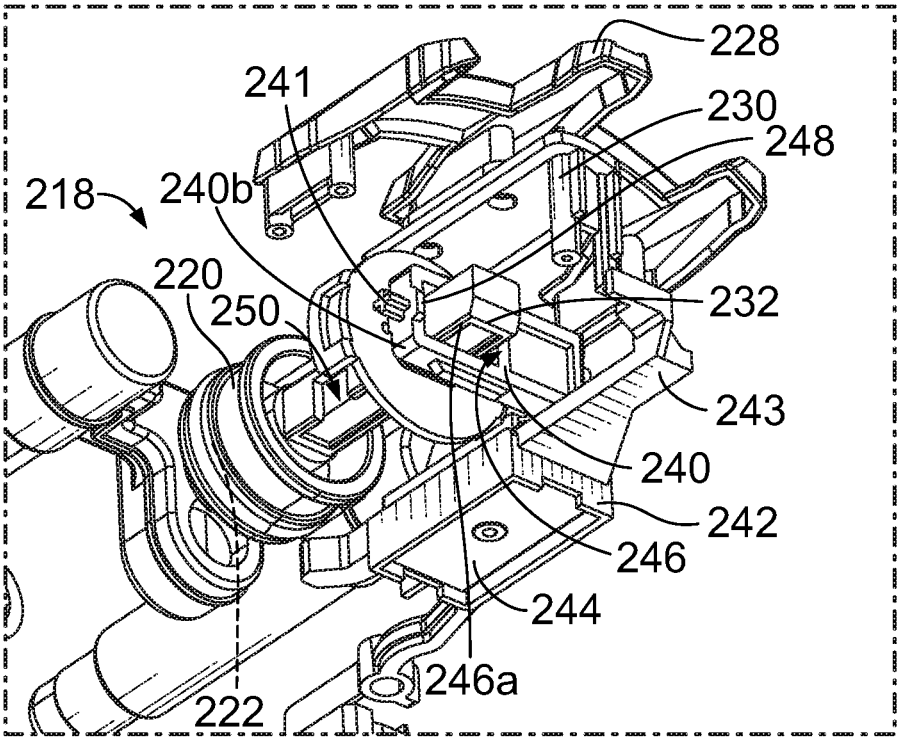

In another alternative toy projectile apparatus embodiment 200, as seen in FIGS. 3A-3C, a housing assembly 210 is generally comprised of a durable plastic with a wearable component designed like a glove to fit over the back of a user's hand and includes a rail 211 for the user to grip. An outer housing portion 210*a* of the housing assembly, as seen in FIG. 3A, is shaped and embellished to resemble equipment worn and used by a superhero Black Panther, with a cat like paw and claws 212 extending from the finger portions of the housing assembly, which suggests a user will swipe forward in a cat like paw swipe "Power move" in order to apply the appropriate force and direction of acceleration needed to trip the inertia trigger in the present described alternative toy projectile apparatus.

Two projectile receiving assemblages 214 are disposed at the housing assembly and are cylindrically shaped to fit the cylindrical darts 216 which are movably deployed within each projectile receiving assemblage. A launching mechanism 218, generally similar to the launching mechanism as described above for the present described embodiments 10 and 100, includes a piston 220 and a compression launch spring (not shown) but housed within a cylinder 224, such that when one or more of the darts are launched, the air above the piston 220 in the cylinder 224 quickly enters the projectile receiving assemblages 214 behind the one or more darts to cause firing of the darts.

Figure 3D:
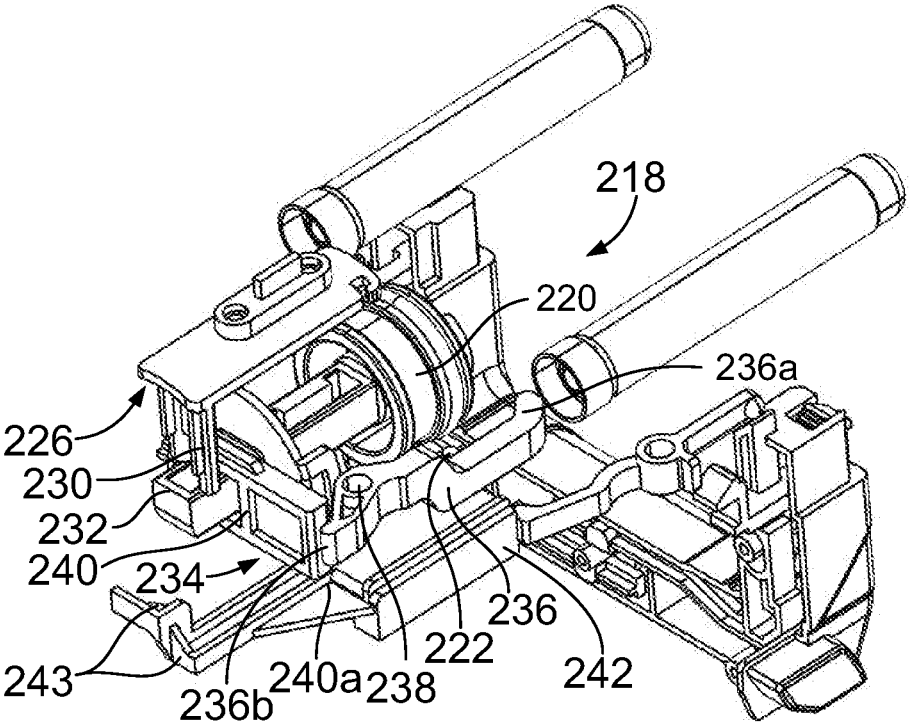
FIG. 3D illustrates a sub-housing assembly containing the actuator movement mass and advancing along a defined path with an affixed release point element.

A priming mechanism 226 engages the launching mechanism 218 for manual charging/priming of the launching mechanism. The launching and priming mechanisms together form a sub-assembly that moves with respect to the housing assembly between a primed and discharged position. The priming mechanism, as seen in FIGS. 3B-3D, includes a three prong claw shaped handle 228 connected to a linkage 230 which mechanically engages a plunger 232 that is affixed to the piston 220. The user pulls back on the claw handle 228, drawing the plunger and affixed piston away from the projectile receiving assemblages and compressing the spring as the piston is temporarily latched to a primed/charged position.

In the present described alternative embodiment, as seen in FIGS. 3C & 3D, a release point trigger release mechanism 234 is disposed within the housing assembly and includes a first trigger linkage 236 pivotably connected to the housing assembly at pivot point 238, and a second trigger linkage 240 engaging the first trigger linkage at a first end 240*a* and engaging the plunger 232 at a second end 240*b*, and a release point post 222 affixed to a sub-housing 242 disposed within the housing assembly and containing an actuator movement mass 244. The second trigger linkage 240 includes an aperture 246 through which the plunger can traverse and a squared off protrusion 248 at and inside surface 246*a* of the aperture, which operates to engage a squared off notch 250 in the plunger, as seen in FIG. 3C. The second trigger linkage 240 is spring biased at post 241 toward the first trigger linkage. The protrusion 248 of the second trigger linkage 240 engages the notch 250 of the plunger when the launching mechanism (piston & plunger) is manually pulled to a primed position, biasing together the connection between the protrusion 248 and notch 250 with the spring at post 241.

A safety mechanism 252, as seen in FIG. 3B, engages the actuator movement mass 244 at the sub-housing, to prevent advancement of the mass and actuation of the inertia trigger mechanism until the user is ready to shoot projectiles from the apparatus. The safety mechanism must be released for the actuator movement mass to advance. The safety mechanism includes a pair of safety buttons 254 with a first linkage 255 therebetween mechanically engaging the safety buttons, and a second linkage 256 mechanically engaging the first linkage, and a third linkage 257 mechanically engaging the sub-housing and/or actuator movement mass. The safety buttons 254 are disposed on either side of the rail 211 of the housing assembly and are easily and logically accessible to the user when gripping the rail with either the right or left hand. The safety buttons 254 are spring loaded and biased to the locked position, which prevents the actuator mass from advancing.

In operation, the user depresses and holds one of the safety buttons with a thumb most likely, releasing the safety mechanism by shifting the first linkage to lift the second linkage toward the third linkage and pivot an L shaped end 257*a*, away from engagement with the sub-housing and/or actuator movement mass, freeing the mass to advance when a force with certain acceleration is applied, such as a cat like paw swipe, as discussed above. Selective movement of the actuator movement mass from a "Power move" including a paw swipe motion by the user, shifts the mass and affixed release point post 222 toward a first end 236*a* of the first trigger linkage 236, pivoting the second end 236*b* of the first trigger linkage toward the second trigger linkage 240 and shifting the second trigger linkage against the spring bias, such that the protrusion 248 disengages from the notch 250 to quickly release the plunger and attached piston shooting projectiles from the apparatus. After shooting the projectile, the actuator movement mass is returned to an inactive/unadvanced/unshifted position by the priming mechanism, when the launching mechanism is once again primed, as the priming mechanism mechanically engages the mass though one or more linkages 243 affixed to the sub-housing 242. The safety buttons are then released, and the spring loaded buttons will pull away from the linkage assemblies, pivoting the L shaped end 257*a* back into engagement with the sub-assembly/actuator movement mass, preventing the mass from freely advancing.

Figure 4A:
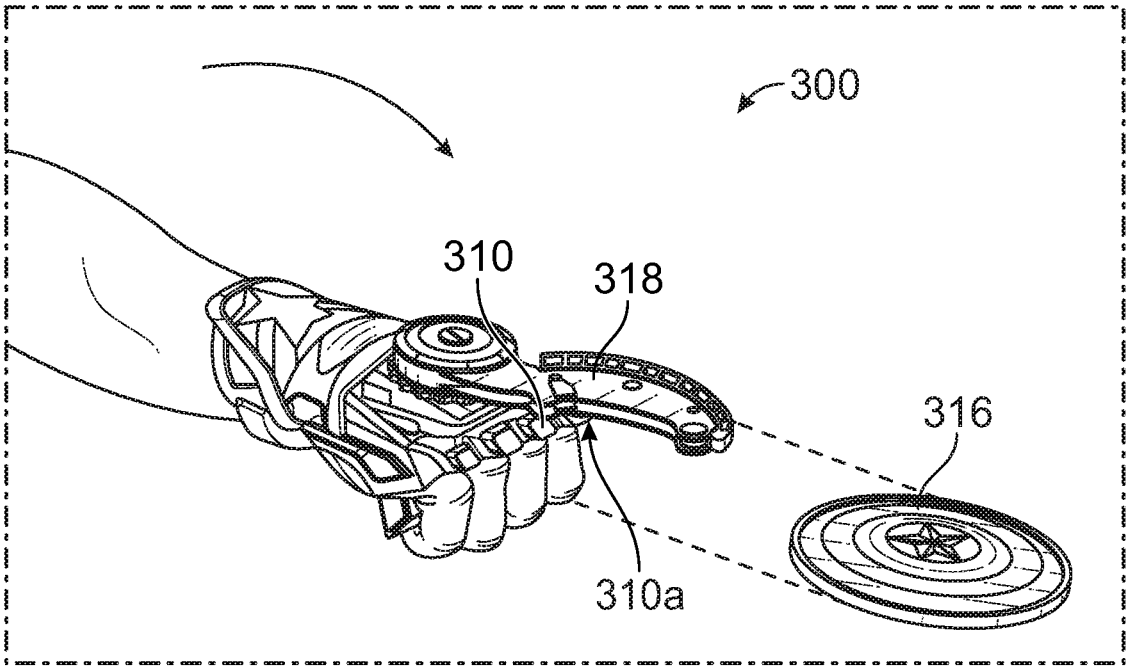
FIG. 4A is a perspective view of an alternative embodiment of the toy projectile apparatus according to the present invention, illustrating a wearable housing assembly with Captain America indicia and a user applying a Captain America Power frisbee like flick of the arm disc throw move to shoot a projectile from a projectile receiving assemblage.
Figure 4B:
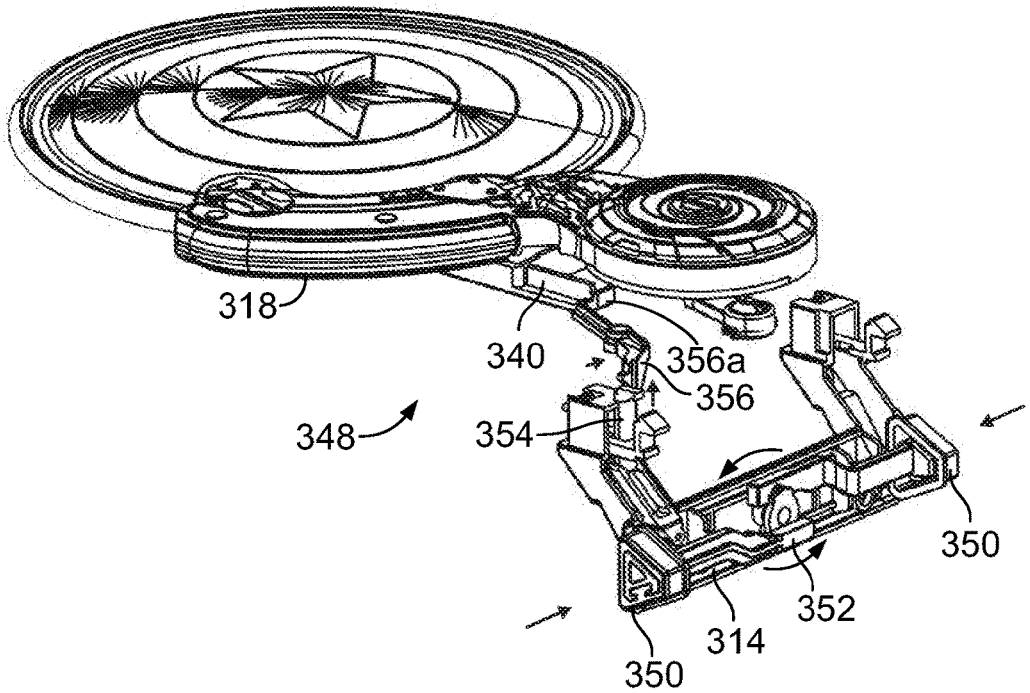
Figure 4C:
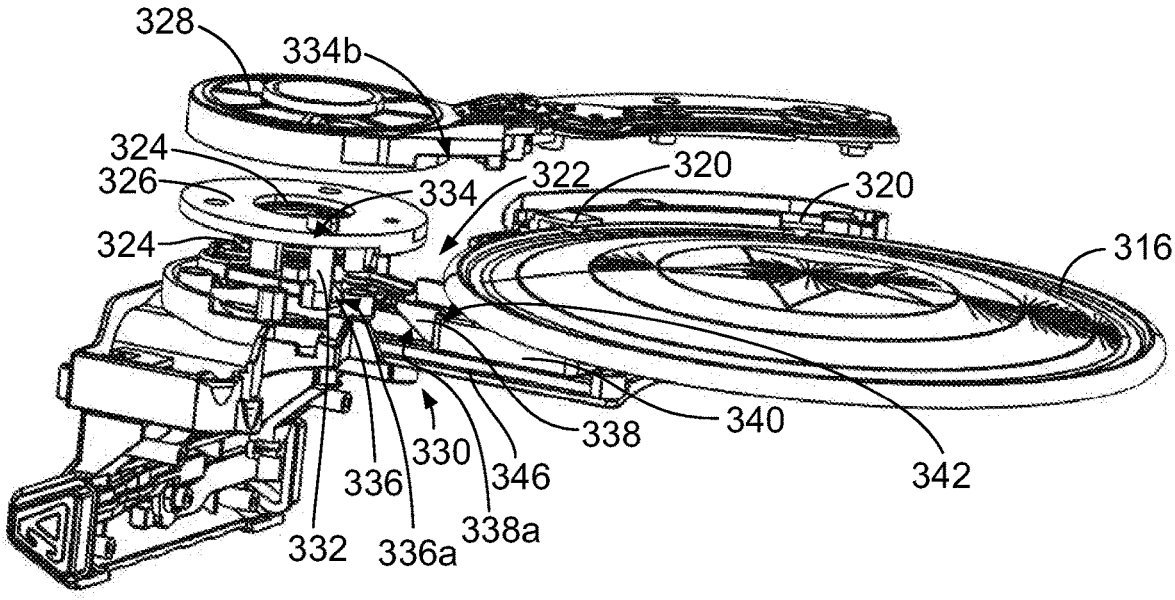
FIG. 4C illustrates a launching and priming mechanism sub-assembly and an actuator movement mass/sub-housing with a trigger element movable with the mass and a release point element secured to a pin which is spring biased toward the priming mechanism for retaining the launching mechanism in a primed position.

In another alternative toy projectile apparatus embodiment 300, as seen in FIGS. 4A-4C, a housing assembly 310 includes a wearable component and a hand held rail 314 generally comprised of a durable plastic material with the wearable component worn on the back of the hand of a user with the user gripping the rail. An outer housing portion 310*a* of the housing assembly is shaped and embellished to resemble equipment used and worn by a superhero Captain America, with a disc/shield projectile 316 resembling a shield and including Captain America's Power star, and body armor knuckle protectors for a battling effect. The look and design of the outer housing portion suggests a "Power move" of frisbee like flick of the arm disc throw, as seen in FIG. 4A and demonstrated with the arrow as shown, in order to apply the appropriate force and direction of acceleration needed to trip the inertia trigger in the present described alternative toy projectile apparatus embodiment 300. Additionally, a punch "Power move" can also be performed to apply the appropriate force and direction of acceleration needed to advance the actuator movement mass of the apparatus.

A projectile receiving assemblage 318 is disposed at the housing assembly 310 and is crescent shaped to receive the disc shaped projectile 316. The crescent shaped projectile receiving assemblage utilizes clips 320 and friction to retains the disc projectile, as seen in FIG. 4C. A launching mechanism 322 is disposed adjacent the projectile receiving assemblage 318 for launching the projectile from the assemblage. In the present alternative embodiment 300, the launching mechanism generally includes a torsion spring 324 within a sub-housing launching assembly 326 topped by a cap 328 for ease in winding the torsion spring/launching mechanism to a primed position. The user grips the cap of the sub-housing launching assembly and rotates the assembly clockwise until the torsion spring is wound to a primed position.

A release point trigger release mechanism 330 is disposed within the housing assembly and engaging the launch assembly to temporarily latch the launching assembly to a primed/charged position. The release point trigger release mechanism includes a pin element 332 affixed to the housing assembly and spring biased to a catch position, as seen in FIG. 4C, disposed through an aperture 334 in the sub-housing of the launching mechanism. The pin element 332 includes a release point element 336 affixed to the pin and includes an angled surface 336*a*. The release point trigger release mechanism also includes a short trigger linkage 338 affixed to a sub-housing 340 AVN Signature Moves FIGS. 1-741 which contains an actuator movement mass. 342. The short trigger linkage includes a diagonal contacting surface 338*a* for contacting the angled surface 336*a* of the release point element 336. When the actuator movement mass is advanced, the trigger is slid over the release point element, depressing the pin 332, and shifting the pin away from the sub-housing launching assembly 326.

The actuator movement mass 342 is deployed at the housing assembly and engages the release point trigger mechanism 330, as described above. The actuator mass is selectively activated through a certain acceleration to trip the release point trigger release mechanism and fling the shield projectile from the apparatus. The actuator movement mass is a weight generally housed within the sub-housing 340 which affixes the short trigger linkage 338 and is moveable with the affixed trigger linkage 338 with respect to the housing assembly 310.

A safety mechanism 348, as seen in FIG. 4B, engages the actuator movement mass at the sub-housing 340 to prevent advancement of the mass to actuate the trigger and shoot the disc shield projectile until desired by the user. The safety mechanism 348 includes three linkage assemblies latching the actuator mass/sub-housing to a pair of safety buttons. The safety buttons 350 are disposed on either side of the rail 314 of the housing assembly and are easily and logically accessible to the user when gripping the rail with either the right or left hand. The safety buttons are spring loaded and biased to the locked position, which prevents the actuator mass from advancing.

In operation, the user depresses and holds one of the safety buttons, with a thumb most likely, releasing the safety mechanism by shifting the first linkage 352, which is disposed between the two safety buttons, to shift the second linkage 354 up toward the third linkage 356 which is pivoted away from engagement with the actuator mass/sub-housing. The third linkage 356 includes an L shaped end 356*a*, which is pivoted away from the actuator mass/sub-housing when the safety mechanism is held in an unlocked position, freeing the mass to advance when a force with a certain acceleration is applied, such as a flinging motion, as discussed above.

The actuator mass/sub-housing 340 rides along a track 346 when the selective movement of the actuator movement mass is advanced by a "Power move" by the user to fling the apparatus forward and advance the actuator mass/sub-housing and connected trigger linkage toward the release point 336 until the diagonal contacting surface of the trigger linkage contacts the release point and depresses the pin element to release the primed torsion spring and shoot the shield projectile. After shooting the shield projectile, the safety buttons are released and the spring loaded buttons will pull away from the linkage assembly, pivoting the L shaped end 356*a* back into engagement with the actuator movement mass/sub-assembly, preventing the mass from freely advancing. The actuator movement mass is returned to an inactive/unadvanced/unshifted position by the priming mechanism, when the launching mechanism is once again primed, as the priming mechanism mechanically engages the mass though one or more linkages affixed to the sub-housing 340.

Figure 5A:
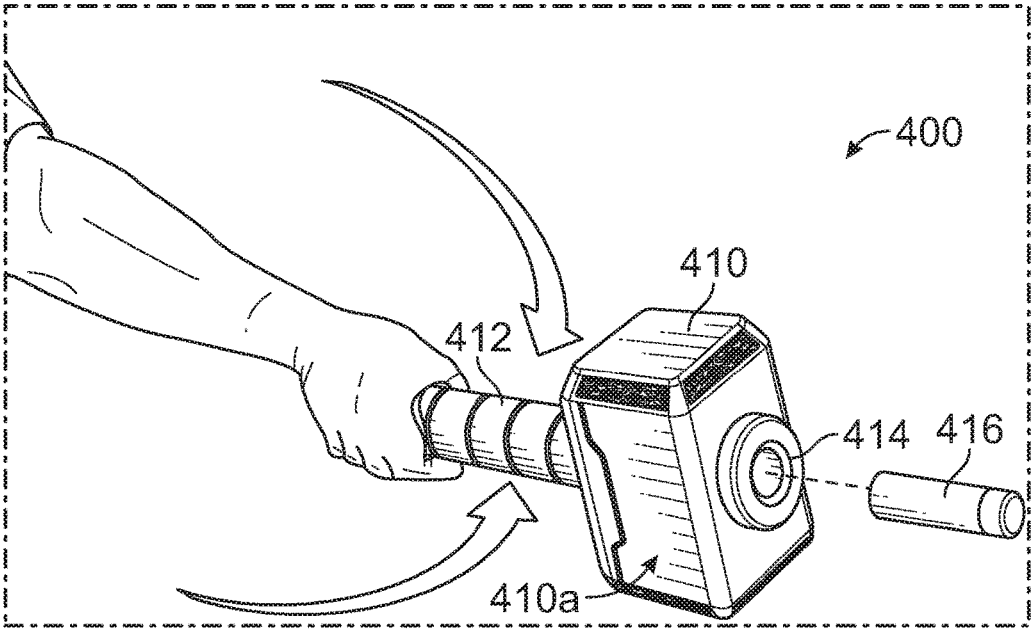

In another alternative toy projectile apparatus embodiment, 400, as seen in FIGS. 5A-5D, a housing assembly 410 is generally comprised of a durable plastic material and includes a handle component 412. An outer housing portion 410*a* of the housing assembly is shaped and embellished to resemble equipment used by superhero Thor, with a hammer configuration appearing to have a very heavy hammer head. The look and design of the outer housing portion suggests a Thor "Power move" of a hand held hammer swing motion, as seen in FIG. 5A and demonstrated with the arrow as shown, in order to apply the appropriate force and direction of acceleration needed to trip the inertia trigger in the present described alternative toy projectile apparatus embodiment 400.

A projectile receiving assemblage 414 is disposed at the housing assembly 410 and is cylindrically shaped to fit a cylindrical dart 416 which is movably deployed within the projectile receiving assemblage. The projectile receiving assemblage frictionally retains the projectile 416. A launching mechanism 418 is disposed adjacent the projectile receiving assemblage 414 for launching the projectile from the assemblage. The launching mechanism is generally similar to the launching mechanism as described above for the present described embodiment 10, and includes a piston and a compression launch spring housed within a cylinder 420, such that when the dart is launched, the air above the piston in the cylinder 420 quickly enters the projectile receiving assemblages 414 behind the dart to cause shooting of the dart.

A priming mechanism 422 engages the launching mechanism 418 for manual charging/priming of the launching mechanism. The launching and priming mechanisms together form a sub-assembly that moves with respect to the housing assembly between a primed and discharged position. The priming mechanism, as seen in FIG. 5D, includes a rounded grip 424 at an end of the handle 412 opposite a hammer head portion 426 and connects through a linkage 427 to a plunger 428 that is affixed to the piston (not shown). The user pulls back on the grip 424, drawing the plunger and affixed piston away from the projectile receiving assemblage and compressing the spring as the piston is temporarily latched to a primed/charged position.

As seen in FIG. 5D, a release point trigger release mechanism 430 is disposed within the housing assembly and cooperates with an actuator movement mass 450 to shoot the projectile. The release point trigger release mechanism includes a first trigger linkage 432 pivotably affixed to the housing assembly at pivot point 434, and a second trigger linkage 436 engaging the first trigger linkage at a first end 436*a* and engaging the plunger 428 at a second end 436*b*. A spring 438 biases the second trigger linkage toward the first trigger linkage. The release point trigger release mechanism further includes a release point element 339 disposed within the handle portion 412 of the housing assembly and connected through a long linkage 437 to move with the actuator movement mass 450. The long linkage 437 includes a triangular head element 439 which will ride along angled ridges 451 of the actuator movement mass to pivot the first trigger linkage 432 and shoot the projectile.

The second trigger linkage 436 includes an aperture 440 in which the plunger can traverse and a squared off protrusion (not shown but same as protrusion 248 in FIG. 3C) at an inside surface of the aperture which operates to engage a squared off notch (not shown but same as notch 250 in FIG. 3C) in the plunger. The squared off protrusion of the second trigger linkage engages the notch of the plunger when the launching mechanism (piston & plunger) is manually pulled to a primed position. Also, the spring 438 biases the squared off protrusion of the second linkage 436 against the squared off notch of the plunger creating a secure coupling.

Figure 5B:
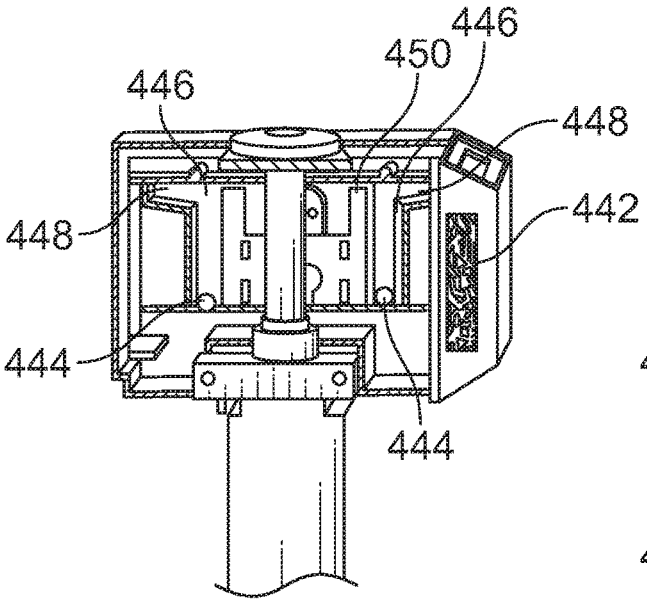
FIGS. 5B & 5C illustrate a safety mechanism for preventing advancing/shifting an actuator movement mass, until shooting the projectile is desired by the user.
Figure 5C:
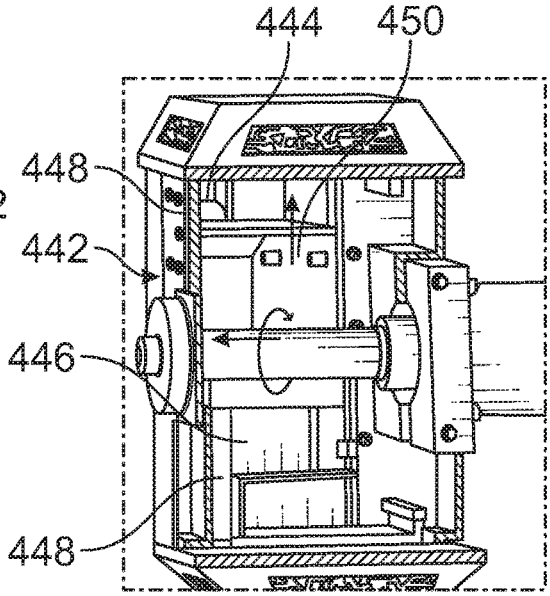
Figure 5D:
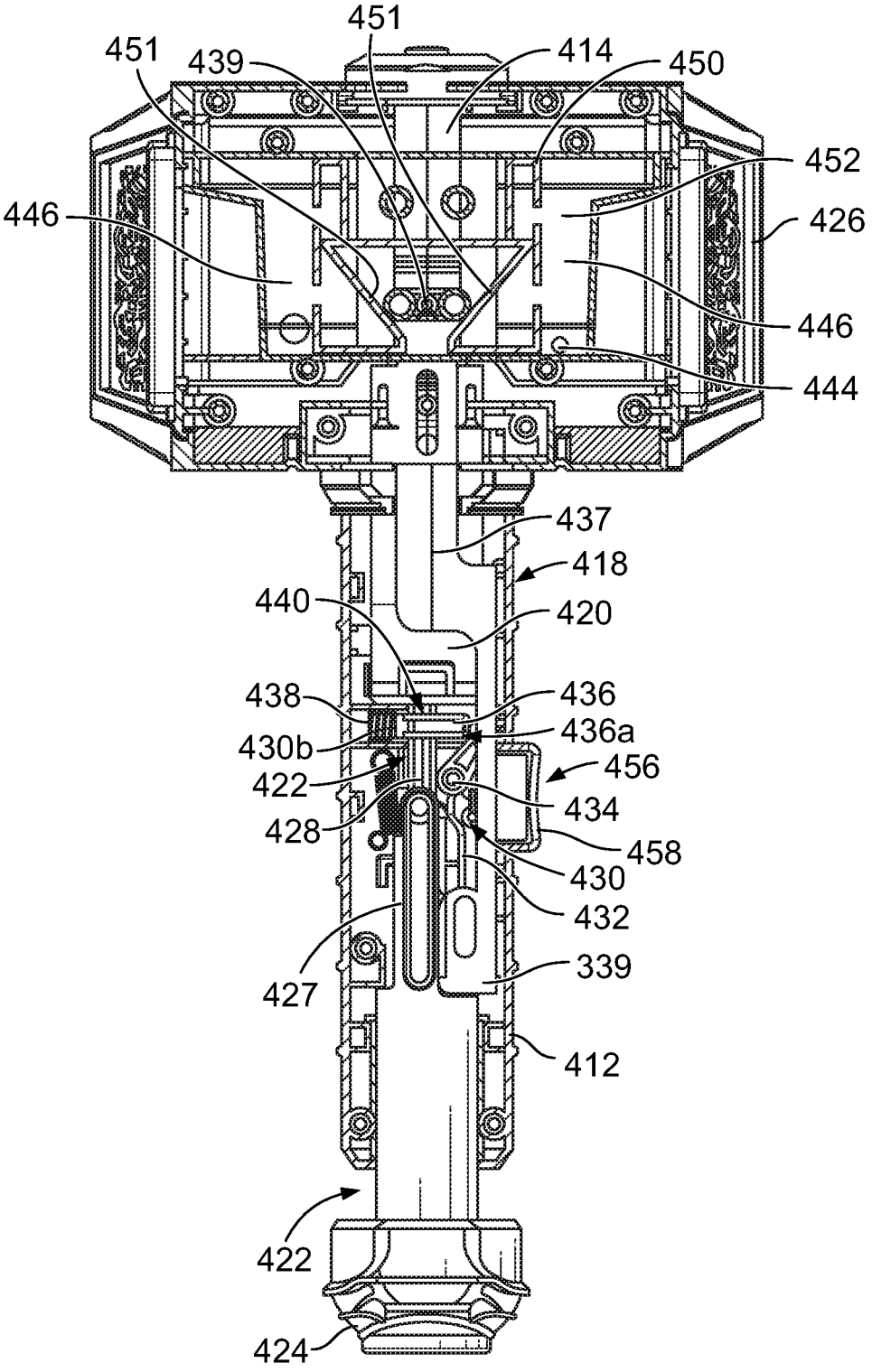
FIG. 5D illustrates a launching and priming mechanism sub-assembly and an actuator movement mass/sub-housing with a release point element movable with the mass and two trigger linkages, one pivotably secured to the housing assembly, and the other one latching a plunger to retain the launching mechanism in a primed position.

A safety mechanism 442, as seen in FIGS. 5B & 5C, includes a ball 444 and channel 446 configuration for preventing movement of an actuator movement mass 450 until the apparatus is aligned in such a position as to allow the ball to roll into a dip 448 in the channel and free the mass to shift allowing the apparatus to shoot the projectile when desired by the user. The actuator movement mass 450 is contained within a sub-housing assembly 452 and shifts laterally within the sub-housing assembly as seen in FIGS. 5B-5D. The mass 450 is held toward the center of the housing assembly through engagement with the triangular head element 439 of the long linkage 437. The space on either side of the centered mass 450 defines the channels 446, into one of which, the mass will traverse when the user swings the apparatus with a certain force in a specific manner, a shown with arrows, in FIG. 5A.

In operation, selective movement of the toy projectile apparatus 400, from a "Power move" including a hammer swing by the user, shifts the safety mechanism to release the actuator movement mass by first rolling both balls 444 along the channels 446 toward the dips 446 in the channels as the hammer head is lowered beneath or to the level of the hammer handle, as seen by the upper arrow as demonstrated in FIGS. 5A & 5C. As the user swings the hammer head back up, as seen and demonstrated by the lower arrow in FIGS. 5A &5C, the ball 444 in the channel disposed upward of the actuator movement mass, will drop into the adjacent dip as the hammer head is swung upward. The toy projectile apparatus 400 will shoot the dart at this later upward movement of the hammer head as demonstrated by the lower arrow in FIG. 5A.

The removal of the ball into the dip will allow the actuator movement mass 450 to shift toward the now empty channel, as seen in FIG. 5C. Shifting of the actuator movement mass will advance the triangular head element 439 further into the mass sub-housing as the head element rides along the ridge 451 of the mass when the mass shifts. The long linkage 437 affixed to the head element is also advanced with the head element and the affixed release point element 339 is advanced over the first trigger linkage 432, pivoting the first trigger linkage. The pivoted first trigger linkage shifts the second trigger linkage 436 against the spring bias 438 such that the protrusion within the aperture of the second trigger linkage disengages from the notch in the plunger to quickly release the plunger and attached piston shooting the projectile from the apparatus.

A second safety mechanism 456, as seen in FIG. 5D, engages the release point element in order to prevent the element 339, long linkage 437 and triangular head element 439 from advancing and thus preventing the actuator movement mass 450 from shifting at the sub-housing, preventing actuation of the inertia trigger mechanism until the user is ready to shoot the projectile from the apparatus. The second safety mechanism includes a spring loaded safety button with a linkage (not shown) mechanically engaging the safety button and release point element. The safety button 458 is disposed in the handle 412 of the apparatus and is easily and logically accessible to the user when gripping the handle.

The user depresses and holds the safety button, most likely with the palm of the user's hand when gripping the handle, releasing the safety mechanism by shifting the linkage away from engagement with the release point element, freeing the element, long linkage and triangular head element to advance toward the sub-housing of the actuator movement mass 450 when a force with a certain acceleration is applied, such as a hammer swing, as discussed above. When the safety button is released, the spring loaded buttons once again prevent the release point element from advancing and shooting a projectile from the apparatus 400.

A method for shooting a projectile from a toy projectile apparatus, including the steps of: providing a housing assembly having at least one projectile receiving assemblage, loading a movably deployable projectile into the projectile receiving assemblage, providing a launching mechanism adjacent the projectile receiving assemblage for launching the projectile from the assemblage. Manually priming the launching mechanism with a priming mechanism, engaging the launching mechanism with a release point trigger release mechanism disposed within the housing assembly, and providing an actuator movement mass deployed at the housing assembly and engaging the release point trigger release mechanism, selectively activating the actuator movement mass through a certain acceleration to trip the release point trigger release mechanism and shoot the projectile from the projectile receiving assemblage.

What is claimed is:

1. A toy projectile apparatus, comprising:

a housing assembly having at least one projectile receiving assemblage;

a projectile which is movably deployed within the projectile receiving assemblage;

a launching mechanism adjacent the projectile receiving assemblage for launching the projectile from the assemblage;

a priming mechanism engaging the launching mechanism for manual priming of the launching mechanism;

a release point trigger release mechanism disposed within the housing assembly and engaging the launching mechanism;

an actuator movement mass deployed by a user through a rapid acceleration applied to the housing assembly to advance the actuator movement mass to the release point trigger release mechanism and shoot the projectile from the projectile receiving assemblage; and a safety mechanism that maintains the actuator movement mass in an unadvanced position away from the release point trigger release mechanism when the priming mechanism engages the launching mechanism in a primed position to prevent the release point trigger release mechanism from activating the launching mechanism until desired by the user.

2. The toy projectile apparatus according to claim 1, wherein the actuator movement mass is deployed at the housing assembly with the safety mechanism to prevent activation of the release point trigger release mechanism.

3. The toy projectile apparatus according to claim 2, wherein the actuator movement mass is disposed outside of the housing assembly.

4. The toy projectile apparatus according to claim 2, wherein the safety mechanism further comprises one or more linkage assemblies latching the actuator movement mass to one or more safety buttons accessible to a user for depressing and holding to release the safety mechanism from the mass and allowing the apparatus to shoot the projectile.

5. The toy projectile apparatus according to claim 1, wherein the actuator movement mass is selectively activated through the rapid acceleration to trip the release point trigger release mechanism.

6. The toy projectile apparatus according to claim 5, further comprising a wearable outer housing assembly for securing the housing to the user for the rapid acceleration of the apparatus by the user.

7. The toy projectile apparatus according to claim 1, wherein the safety mechanism locks the actuator movement mass in the unadvanced position away from the release point trigger release mechanism.

8. A toy projectile apparatus comprising:

a housing assembly having at least one projectile receiving assemblage;

a projectile which is movably deployed within the projectile receiving assemblage;

a launching mechanism adjacent the projectile receiving assemblage for launching the projectile from the assemblage;

a priming mechanism engaging the launching mechanism for manual priming of the launching mechanism;

a release point trigger release mechanism disposed within the housing assembly and engaging the launching mechanism; and an actuator movement mass maintained at the housing assembly in an unadvanced position away from the release point trigger release mechanism, preventing engaging of the release point trigger release mechanism and launching mechanism until the actuator movement mass is deployed through a rapid acceleration applied to the housing assembly to shoot the projectile from the projectile receiving assemblage.

9. The toy projectile apparatus according to claim 8, comprising a safety mechanism at the housing assembly with the actuator movement mass deployed to prevent activation of the release point trigger release mechanism.

10. The toy projectile apparatus according to claim 9, wherein the actuator movement mass is selectively activated through the rapid acceleration to trip the release point trigger release mechanism and shoot the projectile from the projectile receiving assemblage.

11. The toy projectile apparatus according to claim 8, wherein the actuator movement mass is selectively activated through the rapid acceleration to trip the release point trigger release mechanism and shoot the projectile from the projectile receiving assemblage.

12. The toy projectile apparatus according to claim 8, wherein the actuator movement mass is deployed and engages the release point trigger release mechanism based on inertia activating the actuator movement mass through the acceleration applied to the housing assembly thereupon advancing the actuator movement mass to the release point trigger release mechanism.

13. The toy projectile apparatus according to claim 8, wherein the unadvanced position is maintained with the actuator movement mass away from the release point trigger release mechanism when the priming mechanism engages the launching mechanism in a primed position to prevent the release point trigger release mechanism from activating the launching mechanism until desired by a user.

14. The toy projectile apparatus according to claim 8, further comprising a safety mechanism that locks the actuator movement mass in the unadvanced position away from the release point trigger release mechanism.

15. A method for shooting a projectile from a toy projectile apparatus, including the steps of:

providing a housing assembly having at least one projectile receiving assemblage;

loading a movably deployable projectile into the projectile receiving assemblage;

providing a launching mechanism adjacent the projectile receiving assemblage for launching the projectile from the assemblage;

manually priming the launching mechanism with a priming mechanism;

engaging the launching mechanism with a release point trigger release mechanism disposed within the housing assembly; and providing an actuator movement mass maintained at the housing assembly in an unadvanced position away from the release point trigger release mechanism, preventing engaging of the release point trigger release mechanism, selectively activating the actuator movement mass through a certain rapid acceleration to trip the release point trigger release mechanism and shoot the projectile from the projectile receiving assemblage.

16. The method for shooting a projectile according to claim 15, engaging a safety mechanism to prevent the actuator movement mass from activating the release point trigger release mechanism until desired by a user.

17. The method for shooting a projectile according to claim 16, latching the actuator movement mass to one or more safety buttons accessible to the user for depressing and holding to release the safety mechanism from the mass and allowing the apparatus to shoot the projectile.

18. The method for shooting a projectile according to claim 15, affixing plural linkages with the release point trigger release mechanism within the housing assembly for engaging the launching mechanism at release point trigger release mechanism to move with the actuator movement mass when the apparatus experiences a certain acceleration.

19. The method for shooting a projectile according to claim 15, disposing the actuator movement mass on the outside of the housing assembly.

20. The method for shooting a projectile according to claim 15, providing a wearable outer housing assembly for securing the housing to a user for the rapid acceleration of the apparatus by the user.

* * * * *